US005992222A

United States Patent [19]

Belonenko et al.

[11] Patent Number: 5,992,222

[45] Date of Patent: Nov. 30, 1999

[54] HIGH PRESSURE PUMP SYSTEM AND METHOD OF OPERATION THEREOF

[75] Inventors: Vladimir Belonenko; Eugenij Bünau, both of Moscow, Russian Federation; Theodor Funck, Göttingen, Germany; Vijcheslav Nikolashev, Moscow, Russian Federation

[73] Assignee: UHP Corp., Portola Valley, Calif.

[21] Appl. No.: 08/571,885

[22] PCT Filed: Jul. 13, 1993

[86] PCT No.: PCT/EP93/01840

§ 371 Date: Jul. 15, 1996

§ 102(e) Date: Jul. 15, 1996

[87] PCT Pub. No.: WO95/02764

PCT Pub. Date: Jan. 26, 1995

[51] Int. Cl.[6] ..... G01N 25/16; F04B 9/02

[52] U.S. Cl. ..... 73/61.76; 73/61.78; 374/46; 374/55; 92/33; 92/84; 92/137; 74/58

[58] Field of Search ..... 73/53.01, 61.41, 73/61.46, 61.47, 61.56, 61.76, 61.78; 374/33, 4–6, 51, 54, 55, 56; 92/31, 33, 84, 137, 132, 130 R; 74/58, 89.17, 110

[56] References Cited

U.S. PATENT DOCUMENTS

| | | | |
|---|---|---|---|
| 2,453,929 | 11/1948 | O'Harah . | |
| 2,966,143 | 12/1960 | Panza . | |
| 3,847,507 | 11/1974 | Sakiyuma et al. . | |
| 4,070,946 | 1/1978 | Sandvik et al. . | |
| 4,072,050 | 2/1978 | Ter-Minassian | 73/61.76 |
| 4,102,782 | 7/1978 | Saito et al. . | |
| 4,837,776 | 6/1989 | Poll . | |
| 4,896,973 | 1/1990 | Hill et al. . | |
| 5,233,884 | 8/1993 | Rochte | 74/581 |
| 5,347,851 | 9/1994 | Grudzien, Jr. et al. | 73/53.01 |

FOREIGN PATENT DOCUMENTS

| | | |
|---|---|---|
| 2527698 | 12/1983 | France . |
| 2164160 | 3/1986 | United Kingdom . |

*Primary Examiner*—Michael Brock
*Attorney, Agent, or Firm*—Baker & Botts, L.L.P.

[57] ABSTRACT

A pump system for producing high and exactly controllable pressure levels includes a piston pump which has a piston (32) connecting to a spindle shaft (22), a spindle nut (44) on said spindle shaft, a cylinder block (34) having a bore (36) for receiving said piston, a mechanism (14, 16, 26) for imparting relative rotational and axial motions between said piston and said cylinder block including a device for causing relative rotary motion of said spindle and spindle nut. A helical spring (46) or other resilient element is connected between said cylinder block (34) and said spindle nut (44) to compensate the reaction force generated by a pressurized fluid sample in said cylinder bore (36) when put under compresion. A flexible element (30) is connected between the piston (32) and the spindle shaft (22) to compensate for any axial misalignment of the piston and the cylinder bore. Methods for operating such a system under adiabatic, isothermal, isobaric and isochoric conditions are described. (FIG. 3).

11 Claims, 7 Drawing Sheets

HIGH PRESSURE PUMP SYSTEM AND METHOD OF OPERATION THEREOF

FIELD OF THE INVENTION

The present invention relates to high pressure systems, more specifically to a high pressure system including a piston pump for producing a high and exactly controllable pressure level in a fluid, and to methods for operating such systems.

DESCRIPTION OF THE RELATED ART

In principle, it should be possible to produce a high pressure level in a fluid with any desired accuracy because a fluid to which a compressing force is applied exerts a counteracting force which is a smoothly varying direct function of the applied force.

However, by this date, close control of high pressure levels in fluids, e.g. in the range above 1 MPa (10 bar) up to e.g. 250 MPa (2,5 kbar) and more has been extremely difficult if not impossible for a number of reasons.

At present, controlled high fluid pressures can be obtained only by means of pumps of the cylinder-piston type. In such pumps, the seal between the movable piston and the cylinder (usually some type of O-ring) is a main cause of problems. For sealing a high fluid pressure, the seal must exert a correspondingly high pressure on the inner wall of the cylinder which creates high frictional forces between these relatively movable elements. This has not only the consequence that a high force is necessary for effecting the required relative motion but also makes the motion jerky because of repetitive transitions between static friction and sliding friction.

Another reason why a smooth, continuous relative motion between a piston and a cylinder of a high pressure pump is difficult to obtain is the presence of reaction forces which are caused by an unavoidable relative misalignment of piston and cylinder axes. Any deviation from an exactly coaxial relationship of piston and cylinder causes reaction forces which depend not only on the actual pressure but also on the relative physical position of the piston and the cylinder. This has prevented the use of a rigid coupling of the piston to a driving member, such as a spindle, which rigid coupling is, however, necessary to obtain close pressure control.

A well known device, the rotating piston balance, a gauging device, avoids the friction problem by using a liquid of high viscosity as seal between piston and cylinder, and by rotating the piston relative to the cylinder simultaneously with a relative axial motion of these elements. The piston is rigidly connected to a platform and the pressure generating force is provided by placing a known mass on the platform while the axis of piston and cylinder are vertical, see e.g. HIGH PRESSURE TECHNOLOGY, Vol. 1, Ian L. Spain et al., Ed., Marcel Dekker, Inc., New York, N.Y., 1977, pp. 285 to 294.

A main drawback of this device is that the axes of piston and cylinder must be exactly aligned with the direction of gravity and that an incremental and automatic pressure control is not feasible. A further, sometimes prohibitive limitation is the necessity to use a liquid of high viscosity for obtaining the required pressure seal.

Thus, generating an exactly controllable high pressure level by means of a piston pump actuated by an automatically controllable drive, as such as an electric motor, is still an unsolved problem.

SUMMARY OF THE INVENTION

It is an object of the invention, to provide a high pressure pump system suitable for producing high pressure levels which can be precisely and smoothly controlled.

Another object of the invention is to provide a high pressure pump system which avoids the above discussed friction and misalignment problems.

A still further object of the invention is to provide a high pressure piston pump system which does not rely on a highly viscose sealing fluid and which can be operated in any desired position.

The invention is embodied in a fluid pump system comprising a cylinder, a piston position within the cylinder and movable relative to it, and driving means for moving the piston and cylinder relatively longitudinally and relatively rotably with respect to each other, said driving means including an actuating member operatively associated to said piston.

According to a first aspect of the present invention, the piston is connected to a spindle which is rotably received in a nut, and the nut and the cylinder are coupled by a spring element. In such a system, the variation of the distance between nut and cylinder is directly proportional to the force acting between cylinder and piston, thus, proportional to the pressure of the fluid in the cylinder.

According to a second aspect of the present invention, a resilient member has a first end fixed to said piston and a second end fixed to said actuating member.

In a preferred embodiment the resilient member is a flexible rod of reduced cross-section integral with the piston and rigidly attached to the actuating member, and the actuating member includes a spindle.

The present pump has a number of essential advantages over the prior art: The pressure can be built up quickly, e.g. from zero to 200 MPa (2000 atm) within about 10 seconds, and the pressure can be very closely controlled, e.g. within about 0,05 MPa (0.5 atm) at a pressure of about 200 MPa (2000 atm). The conditions can be changed quickly, e.g. the pressure can be oscillated with a frequency up to about 5 Hz. The present pump can be used for various investigations, e.g. simulating thermodynamic processes, e.g. Carnot processes, measuring thermodynamic parameters of liquids under a great variety of conditions, and the like.

BRIEF DESCRIPTION OF THE DRAWINGS

Further objects, features and advantages of the invention will become apparent from the following description of preferred embodiments in connection with the accompanying drawings, in which.

Similar elements are provided with like reference numerals.

DESCRIPTION OF THE PREFERRED EMBODIMENTS

Figure 1:
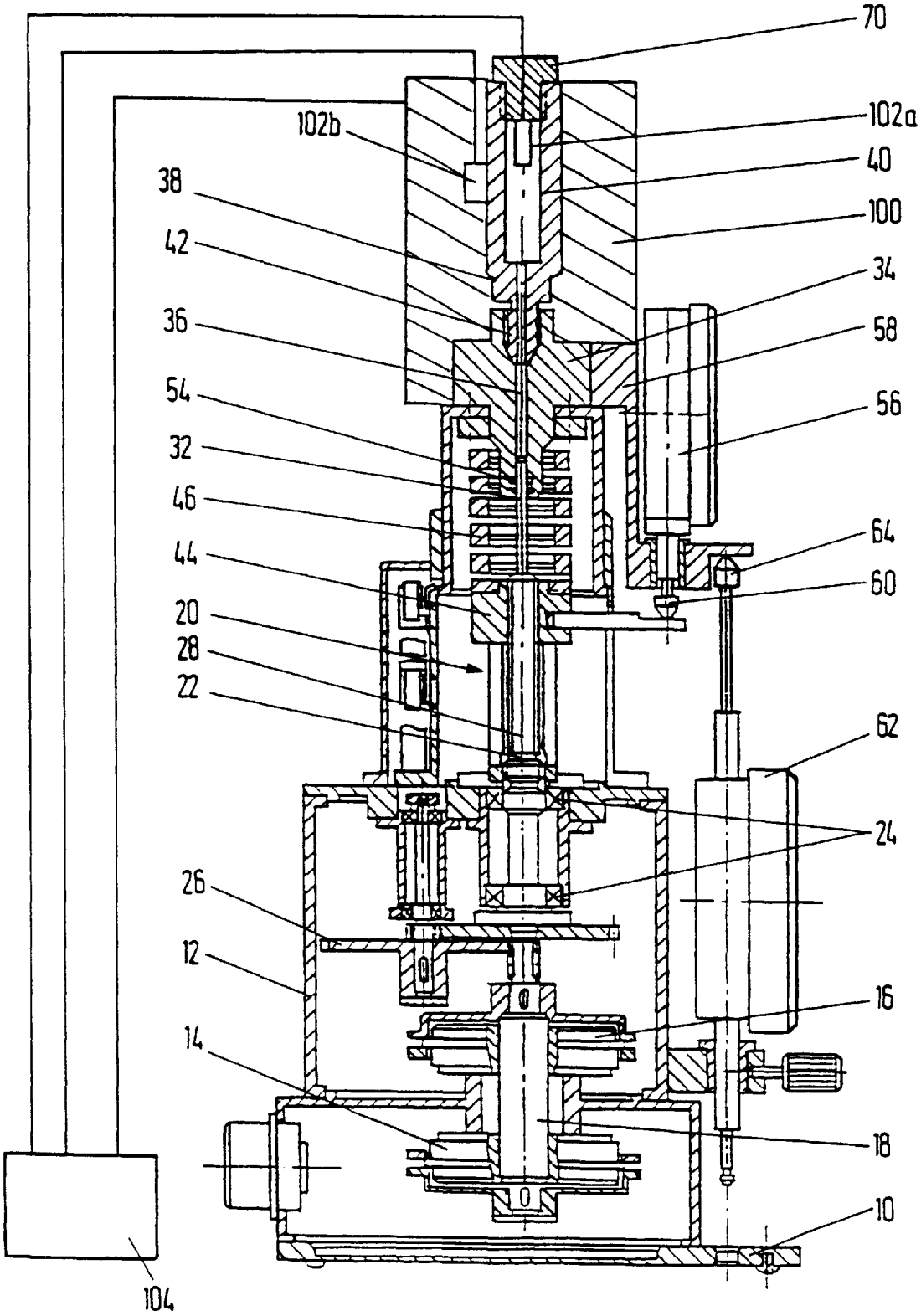
FIG. 1 is a side view partially in section of a high pressure system comprising a high pressure pump according to a first embodiment of the invention.
Figure 2:
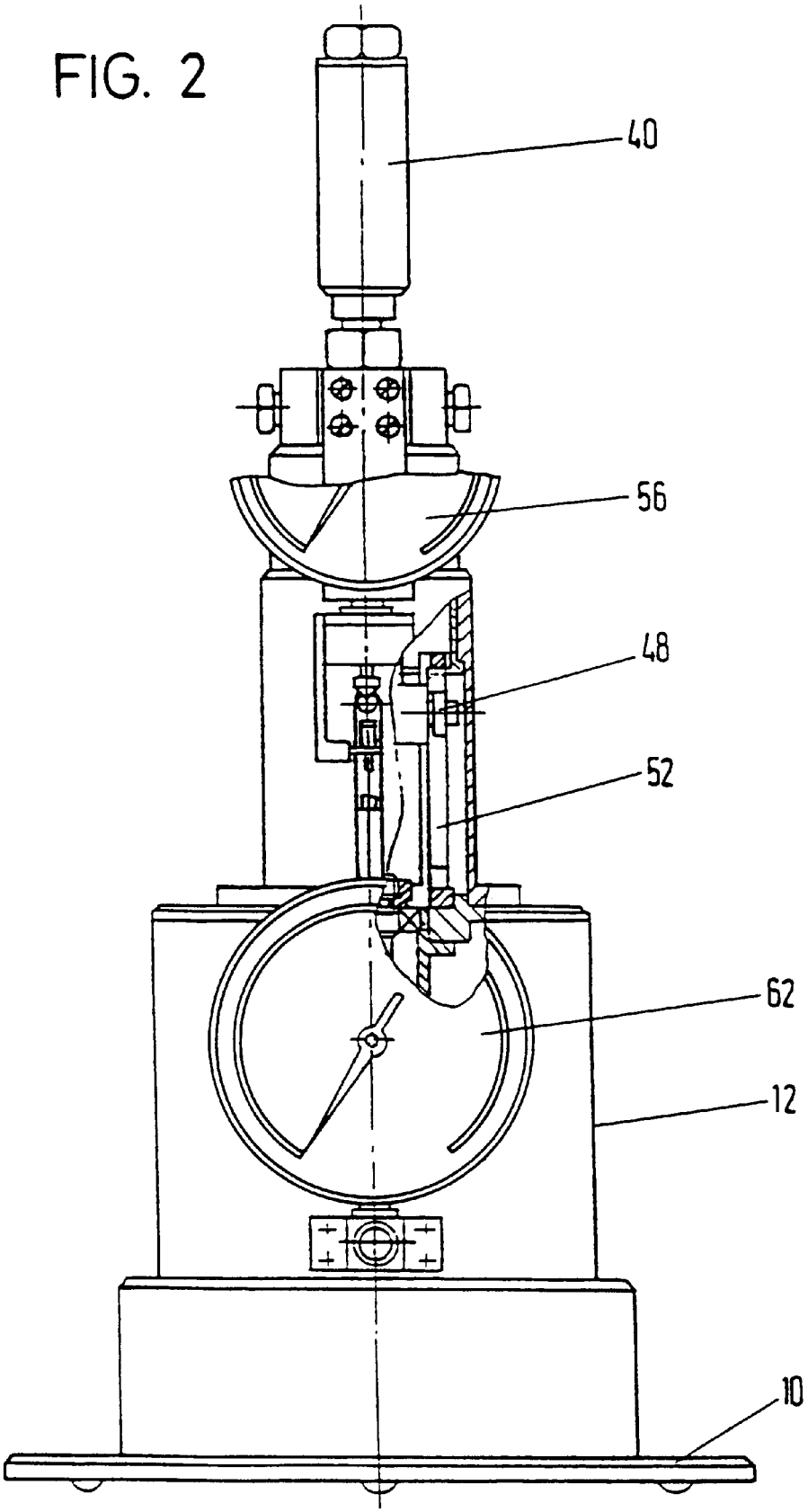
FIG. 2 is a front view partially in section of the system shown in FIG. 1.

Referring first to FIGS. 1 to 4, a high pressure system is shown which includes base plate 10 and a housing or frame structure 12. A pair of electric motors 14, 16 having a common shaft 18 are coaxially mounted in a lower portion of the frame structure 12. A middle portion of the frame structure supports a pump system generally denoted by the reference numeral 20 which will be explained in more detail with reference to FIG. 3. The pump system 20 includes a spindle shaft 22 the lower portion of which is rotably mounted on the frame structure by a pair of roller bearings 24 and the lower end of which is coupled by a reduction gear train 26 to the motor shaft 18. An upper portion of the spindle shaft 22 is provided with a fine thread 28. The upper end of the spindle shaft 22 is connected to one end of a rod-shaped flexible element 30 (FIG. 3) the other end of which being connected to a cylindrical piston 32 both made of steel. The piston 32 is received by a cylinder block 34 which is made of steel and has an axial bore 36. The axial bore 36 communicates with a sample chamber 38 formed by a thick-walled sample container 40 which is connected to the cylinder block 34 by a fluid-tight screw joint 42. The bore 36 and the sample chamber 38 are adapted to receive a liquid sample to be investigated.

The thread 28 of the spindle shaft is received by an internally threaded nut 44 which is coupled to the cylinder block 34 by a flexible element in form of a heavy helical spring 46, dimensioned to withstand the reaction force generated by the sample when it is subject to a compression force.

Figure 3:
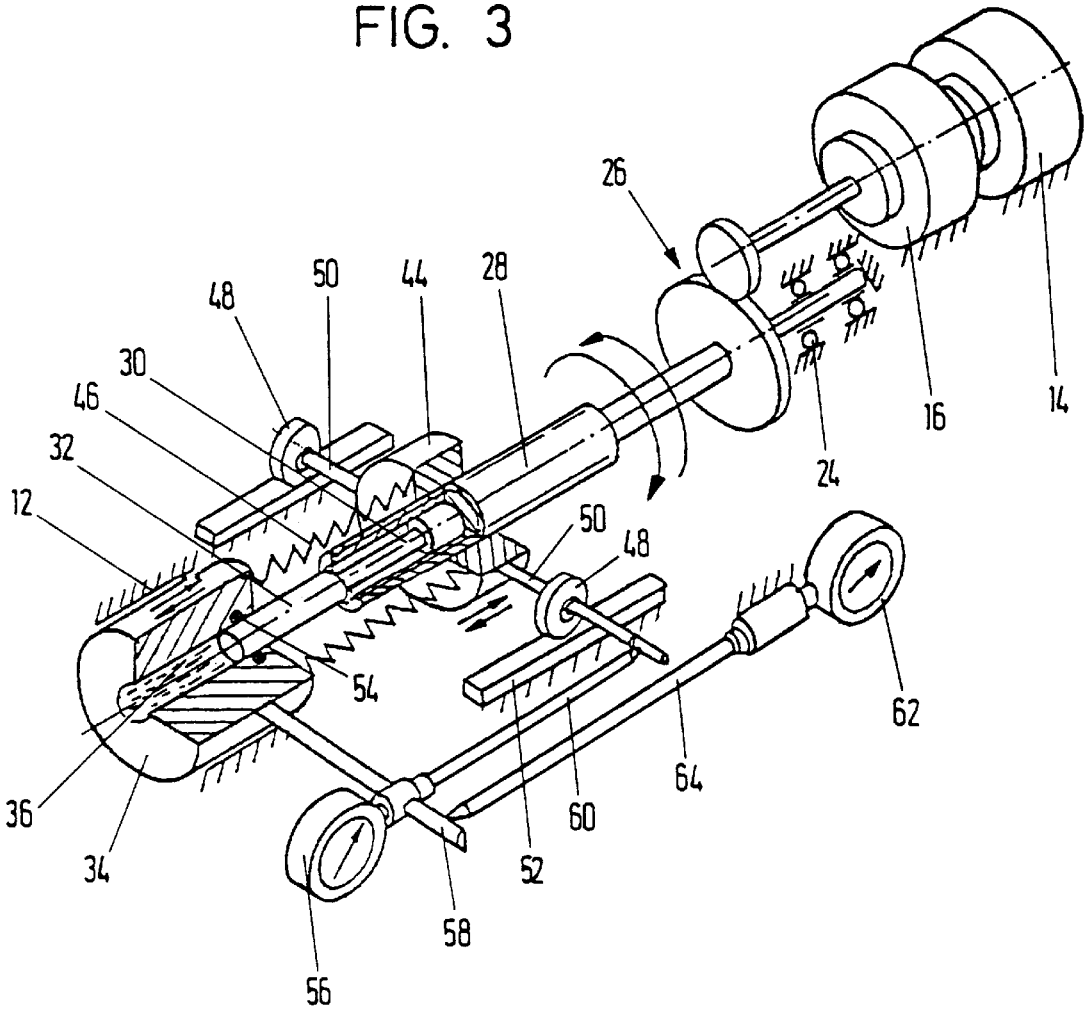
FIG. 3 is an isometric view of essential parts of the system according to FIGS. 1 and 2, in which the piston is mounted rotably but axially stationary while the cylinder is mounted to allow axial movement.

The nut 44 is prevented from rotation by guiding means which includes a pair of rollers 48 which may be formed by ball bearings and are supported by opposite shafts 50 which in turn are fixed to the nut 44 as shown in FIG. 3. The rollers 48 run on straight rails 52 which are fixed to the frame structure.

The bore of the cylinder block 34 is provided with at least one circumferential groove to receive an O-ring 54 for sealing the piston 32 with respect to the cylinder bore 36.

Figure 4:
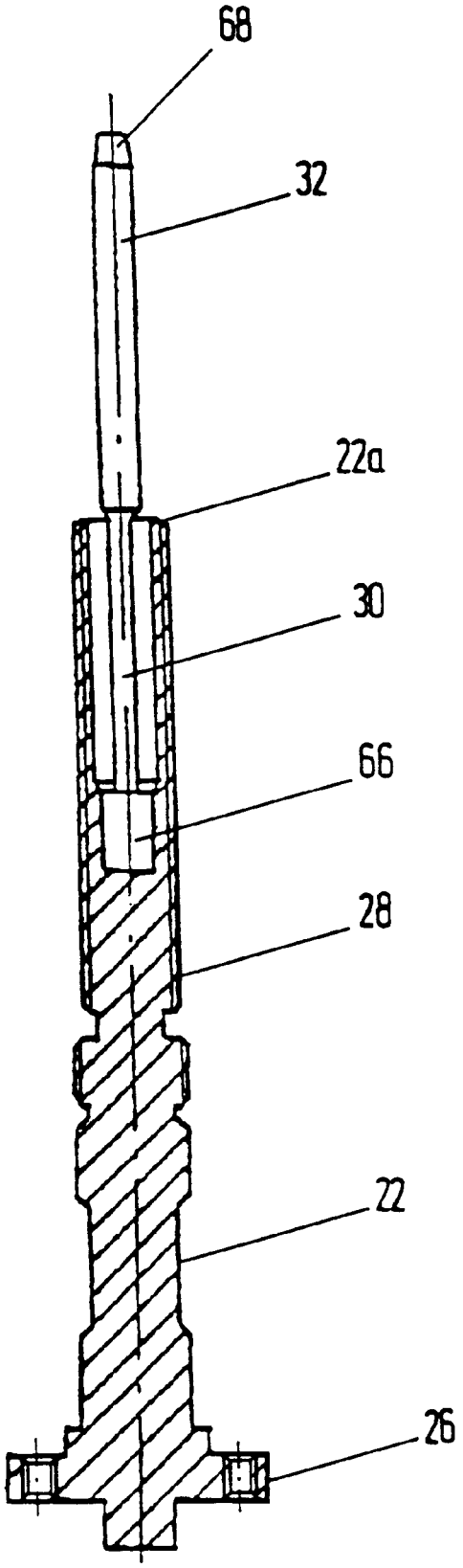
FIG. 4 is an axial section of a spindle-piston unit of the embodiment of FIGS. 1 to 3.

A first distance measuring device 56 is supported by a lateral beam 58 fixed to the cylinder block 34 and having a sensing rod 60 which contacts shaft 50. Another distance measuring device 62 is ajustably mounted on the frame structure 12 and has a sensing rod 64 contacting the beam 58. As shown in FIG. 4, the spindle shaft 22 has a hollow upper portion 22*a*, the most inner section of which forms a seat for receiving, with a press seat, an enlarged cylindrical lower portion 66 of the piston unit which includes this mounting portion 66, the piston 32 and the connecting element 30 as shown in FIG. 4. The cylindrical hollow portion 22*a* surrounds the flexible element to prevent it from buckling. The piston 32 has a tapered free end 68 to facilitate the introduction of the piston through the O-ring seal 54 into the cylinder bore 36.

Operation: The cylinder bore 36 and the sample chamber 38 are completely filled with a liquid sample to be investigated. The sample is introduced via an opening at the upper end of the sample container, the opening being closed by a screw cap 70. When one of the motors 14, 16 or both are energized, the spindle shaft 22 is rotated via the reduction gear train 26. The piston 32 performs a helical motion with respect to the cylinder block and in a first sense of rotation, advances into the cylinder bore 36. The piston performs a pure rotational motion with respect to the frame 12 and, thus, with respect to the cylinder block 34 which is axially movable but prevented from rotation by the roller 48—rail 52 system. The rotation of the piston and the axial movement of the cylinder block result in a helical motion of the piston with respect to the cylinder bore. The rotation eliminates the static friction between the high pressure seal 54 and the piston 32.

The linear movement of the cylinder block 34 relative to the piston 32 is a function of the compressibility of the sample fluid. This linear movement is measured by the distance measuring device 62.

The axial force resulting from the compression of the sample fluid and proportional to the elongation of the spring element 46 is measured by the distance measuring device 56. Thus, this device can be calibrated in units of force or pressure.

The torque acting on the nut 44 as a consequence of the friction forces between the piston 32 and the seal 54 is taken up by the roller 48—rail 52 system. Undesired forces due to axial misalignment of piston 32 and cylinder bore 36 are eliminated by bending of the flexible element 30. The flexible element is protected against buckling by the hollow upper portion 22*a* of the spindle shaft 22 shown in FIG. 4. Close and reliable pressure control is secured by the solid connection between the piston 32 and the spindle shaft 22 afforded by the sufficiently stiff and rigid but also sufficiently flexible element 30.

For investigations on fluid samples under isothermal conditions only one of the electric motors 14, 16 is used for driving the spindle at a relatively low speed. The other motor is used as speedometer.

For investigations under pseudo-adiabatic conditions, both motors which are high-torque dc motors, are energized to effect a fast pressure build-up and compression.

Figure 5:
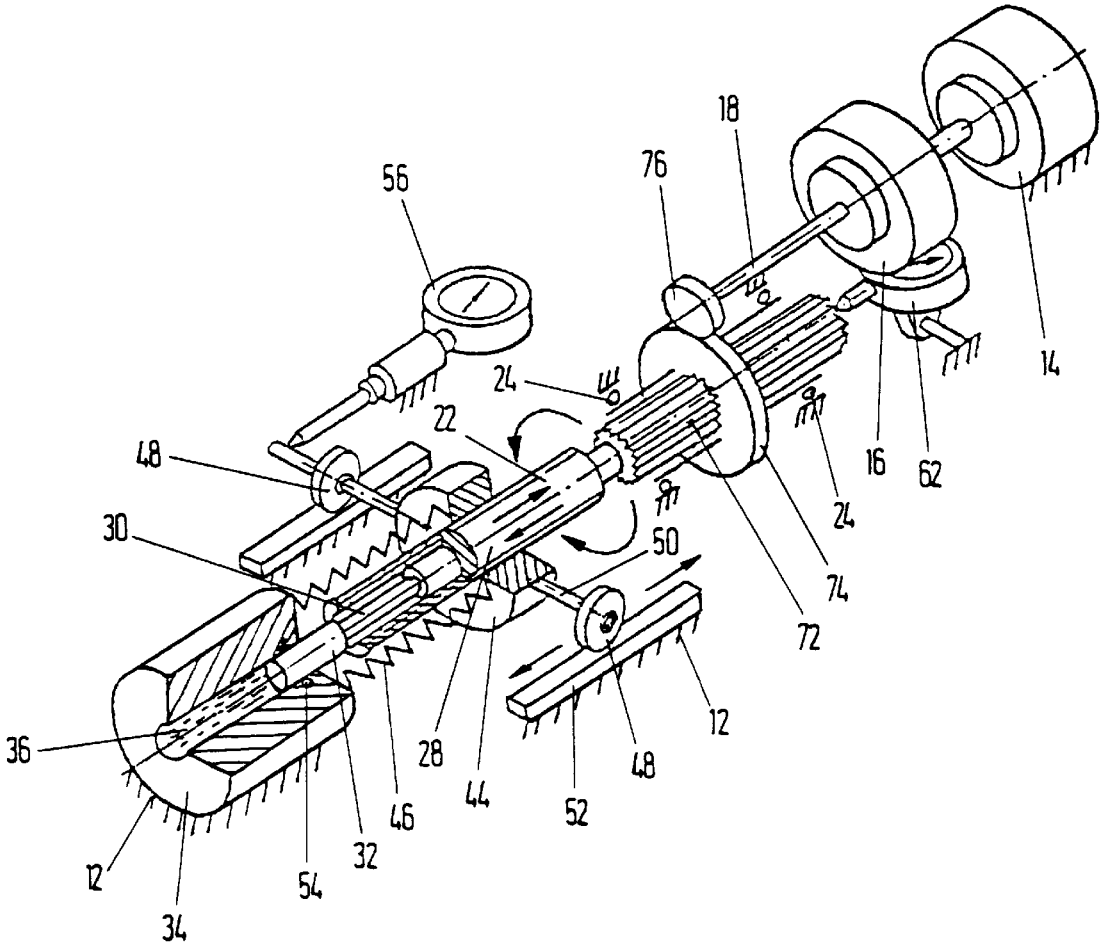
FIG. 5 is an isometric view, similar to FIG. 3, of a modified, second embodiment of the invention in which the cylinder is stationary and the piston is movable both axially and rotably with respect to the cylinder.

FIG. 5 which is similar to FIG. 3 shows essential parts of a modified second embodiment of the invention. The embodiment in FIG. 5 is in many aspect identical with that of FIGS. 1 to 4, thus, only the differences will be explained.

The main difference with respect to FIG. 3 is that the cylinder block 34 is stationary mounted on the frame 12 and the piston 32 is movable both rotably and axially with respect to the cylinder bore 36. To allow such additional axial movement, a rear portion of the spindle shaft 22 is provided with axial splines 72 which are engaged by an internally splined gear wheel 74 which is rotably but axially fixedly supported by ball bearings 24 on the frame 12 and driven by a pinion 76 connected to the motor shaft 18. The distance measuring device 56 for measuring the applied force is coupled between the frame and one of the lateral shafts 50. The distance measuring device for measuring compressibility is coupled between the frame and the rear front end of the spindle shaft 22.

Also in this embodiment, the piston 32 performs a helical, static friction eliminating motion with respect to the cylinder block 34 and a resilient or spring member 46 is provided between the cylinder block and the spindle nut 44.

Figure 6:
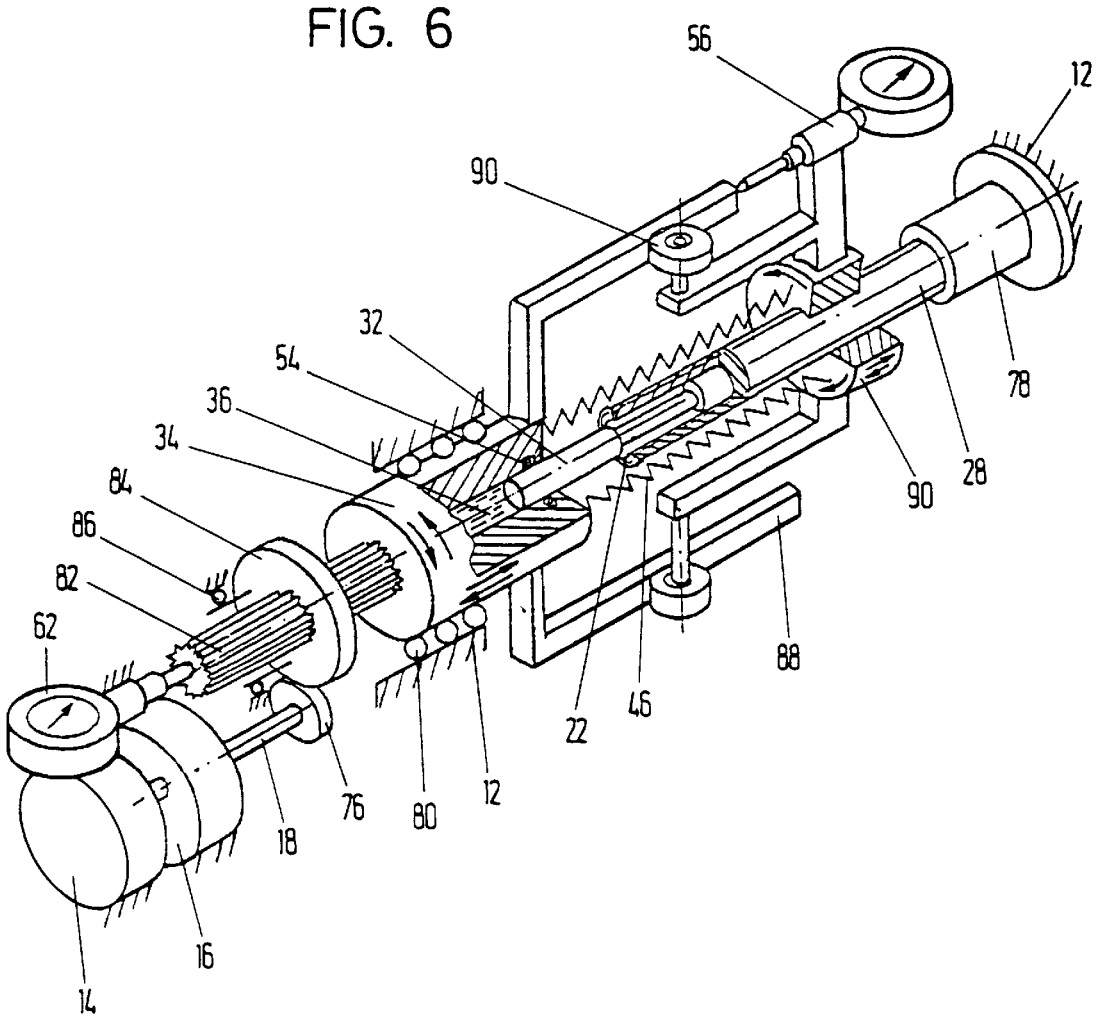
FIG. 6 is an isometric view, similar to FIG. 3 of a third embodiment of the invention in which the cylinder is mounted both rotably and axially movable and the piston is mounted stationary.

The embodiment shown in FIG. 6 differs from the above described embodiments in that the spindle shaft is stationary and fixed to the frame 12 by means of a tube-like fixing member 78 which may form a groove-spline-connection with the spindle shaft to prevent any rotation thereof. The cylinder block 34 is supported on the frame 12 by a bearing system 80 which allows both rotational and axial movement. The cylinder block 34 is connected to a spline shaft 82 which is engaged by an internally splined gear wheel 84 rotably but axially unmovably supported on the frame by bearing means 86. The gear wheel 84 meshes with a pinion 76 fixed on the motor shaft 18. The rotational movement of the cylinder block 34 is transmitted to the spindle nut 44 by a rail 88—roller 90 system. A helical spring 46 or other spring element is coupled between the cylinder block 34 and the nut 44. The force responsive distance measuring device 56 is coupled between the nut 44 and the cylinder block 34, more specifically between the nut 44 and one of the rails 88. The volume responsive distance measuring device 62 is coupled between the frame and the cylinder block 34, more specifically between the frame and the rear front end of the spline shaft 82.

In this embodiment, the axial bore 36 of the cylinder block forms the sample chamber. In a modified embodiment, the axial bore 36 extends into the spline shaft 82. According to a further modification, the spline shaft 82 has an axial bore and is, at its rear end, connected to a sample container similar to container 40 of the embodiment of FIGS. 1 to 4. The device 62 may then be coupled to the free end of such container.

Figure 7:
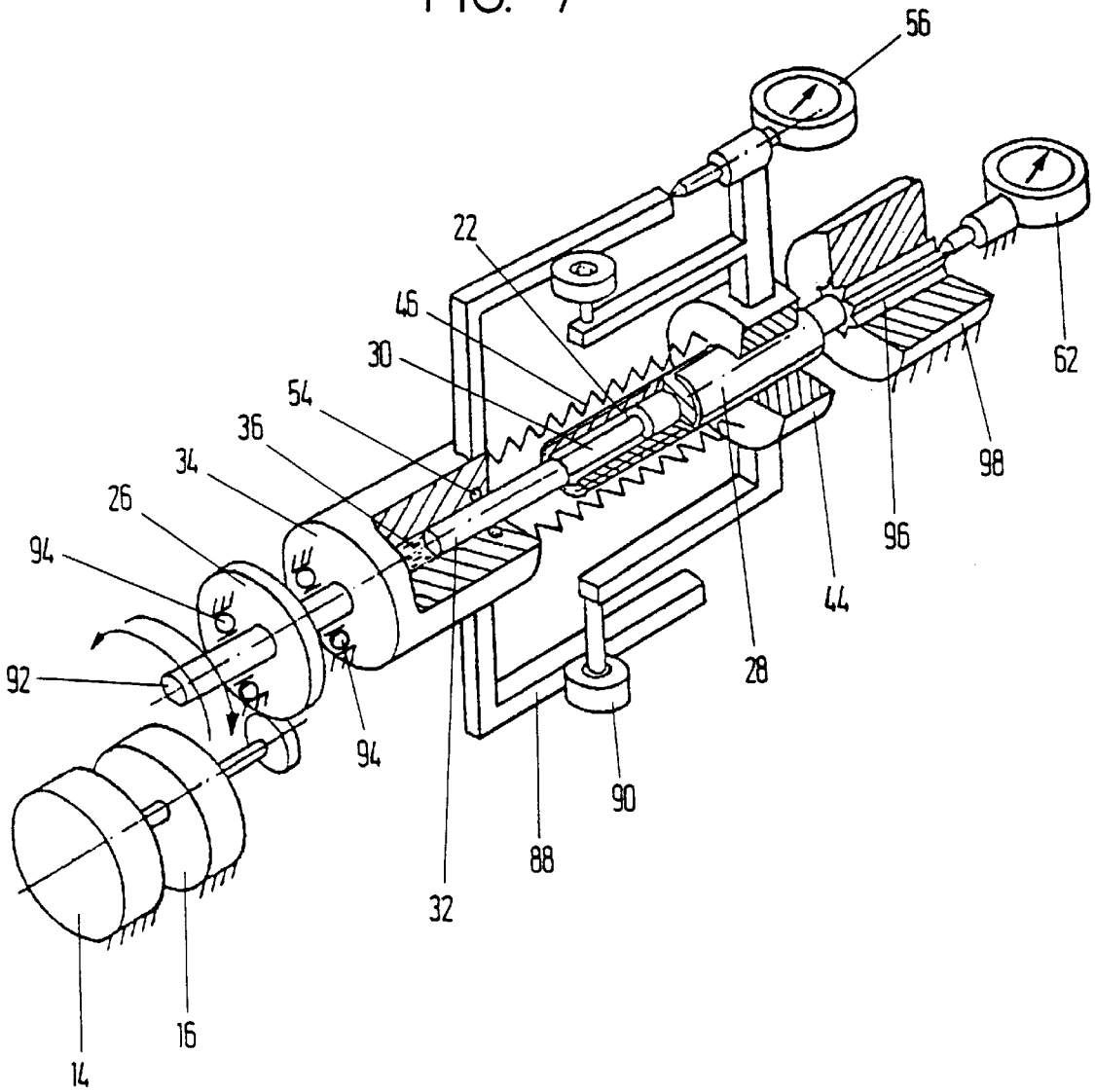
FIG. 7 an isometric view, similar to FIG. 3, of a fourth embodiment in which the cylinder is mounted rotably movable and the piston is mounted axially movable.

The embodiment of FIG. 7 has a rotable but axially fixed cylinder block and an axially but not rotably movable piston 32. The cylinder block 34 is provided with a shaft 92 supported on the frame by bearings 94 and coupled to the motors 14, 16 by gear train 26. The sample chamber is formed by the cylinder bore 36 or additionally by an extension of this bore into the shaft 92 or by a sample chamber (not shown) connected to an axial bore of shaft 92 as explained with reference to FIG. 6.

The spline shaft 22 has a splined rear end 96 received by an internally splined bearing member 98 which allows axial movement but prevents rotation of the spline shaft 22. Nut 44 positioned on thread portion 28 of the spindle shaft 22 is coupled by a rail 88—roller 90 system similar to that of FIG. 6 to the cylinder block 34 to rotate with the latter. The force sensing distance measuring device 56 is coupled between the nut and the cylinder block as shown in FIG. 6. The volume responsive distance measuring device 62 is coupled between the frame and the spindle shaft 22. A helical spring 46 or other spring element connects the cylinder block 34 and the spindle nut 44.

The operation of the embodiments described with reference to FIGS. 5 to 7 should be obvious in view of the explanation of the operation of the embodiment explained with reference to FIGS. 1 to 4.

The systems described above are useful for various types of investigations of fluid samples. A preferred field of application is the assay of crude oil.

Some type of investigations referred to below require changing and measuring the temperature of the sample under investigation. In such cases the systems described above will have to be amplified by some conventional temperature sensors and temperature control means, such as channels for circulating a thermically controlled fluid for controlling the temperature of the chambers containing the sample, i. e. the cylinder block 34 and the sample container 40.

Such temperature control means may comprise a thermostat 100, temperature sensors 102*a*, 102*b*, and a control unit 104.

Generally, the distance measuring devices 56 and 62 which are shown as meters in the drawings will comprise electrical transducers so that an electrical output signal is available for recording and/or control purposes.

It has been already mentioned above that only one of the electric motors 14, 16 is used when a fluid sample is to be investigated under isothermal conditions, the other motor being used as speedometer. Thus, this other motor generates a speed signal which is used to control the energizing power of the driving motor in such a way, that a constant speed of compression results. Simultaneously with the compression, the change of the pressure as sensed by device 56 and the change of the volume as sensed by the device 62 are recorded. If necessary, the temperature of the sample is maintained constant by the thermal control mentioned above.

For investigations under pseudo-adiabatic conditions, both motors are energized to effect fast pressure build-up, and the changes of force and volume are recorded.

When a substance is to be investigated under isochoric conditions, the temperature of the sample is varied and the electric output signal of the volume responsive device 62 is used for controlling the driving motor or motors so that the volume is kept constant during the compression. The changes of pressure and temperature are recorded.

For an investigation under isobaric conditions the temperature of the sample under investigation is varied and the electrical output signal of the force responsive device 56 is used for controlling the driving motor or motors 14, 16 so that the pressure is maintained constant.

Various modifications of the disclosed specific embodiments will occur to those skilled in the art. Thus, the spring element may comprise a bellow element or other resilient means suitable for withstanding the forces involved.

We claim:

1. A pump system comprising;

a frame;

a piston having a longitudinal axis;

a spindle coupled to said piston, said spindle including a shaft and a thread;

a spindle nut mounted on said spindle;

a cylinder block coupled to said frame, said cylinder block having a bore for receiving said piston, said bore being essentially coaxial with said piston and being adapted to receive a fluid sample to be investigated;

a drive assembly for effecting relative rotary and relative axial motions of said piston with respect to said cylinder block, said drive assembly for causing relative rotary motion of said spindle and spindle nut in respect to each other;

a resilient member coupled between said cylinder block and said spindle nut; and a flexible element coupling said piston and said spindle, wherein said flexible element is positioned within a coaxial hollow extension of said spindle.

2. The pump system of claim 1 further comprising:

an assembly coupled to said spindle nut, said assembly preventing rotational motion of said spindle nut;

wherein said drive assembly is operatively coupled to said spindle shaft for imparting purely rotational movement to said spindle shaft;

said spindle nut is provided with means preventing rotational motion thereof; and said cylinder block is mounted in an axially movable manner on said frame.

3. The system of claim 1 wherein said drive assembly is operatively coupled to said spindle shaft to impart both rotational and axial motion to said spindle shaft; said spindle nut is provided with means preventing rotational motion but permitting axial motion thereof; and said cylinder block is affixedly mounted on said frame.

4. The pump system of claim 1 wherein said cylinder block is provided with mounting means permitting both axial and rotational movement thereof; said drive assembly for imparting rotational motion to said cylinder block; coupling means being provided between said cylinder block and said spindle nut; said coupling means coupling said block and said nut to rotate together and allow relative axial motion of said block and said nut, and said spindle shaft is mounted in a substantially stationary manner on said frame.

5. The pump system of claim 1 wherein said cylinder block is mounted for purely rotational motion; coupling means being provided between said cylinder block and said spindle nut; said coupling means coupling said block and nut to rotate together and allow relative axial motion of said block and said nut, and said spindle shaft is mounted in an axially movable but rotationally fixed manner on said frame.

6. The pump system of claim 1 further comprising a measuring device responsive to variations of distance between said cylinder block and said spindle nut.

7. The pump system of claim 1 further comprising a measuring device responsive to volume variations of said fluid sample.

8. The pump system of claim 1 further comprising a sample chamber communicating with said cylinder bore.

9. The pump system of claim 1 further comprising a temperature control system for controlling the temperature of the sample.

10. The pump system as claimed in claim 9 wherein said temperature control system comprises a thermostat, a temperature sensor and a controller operatively coupled to said thermostat and temperature sensor.

11. A pump system comprising:

a frame;

a piston having a longitudinal axis;

a spindle coupled to said piston, said spindle including a shaft and a thread;

a spindle nut mounted on said spindle;

a cylinder block coupled to said frame, said cylinder block having a bore for receiving said piston, said bore being essentially coaxial with said piston and being adapted to receive a fluid sample to be investigated;

a drive assembly for effecting relative rotary and relative axial motions of said piston with respect to said cylinder block, said drive assembly including means for causing relative rotary motion of said spindle and spindle nut in respect to each other;

a resilient member coupled between said cylinder block and said spindle nut; and a measuring device responsive to variations of distance between said cylinder block and said spindle nut.

* * * * *